United States Patent [19]

North et al.

[11] 4,028,054

[45] June 7, 1977

[54] PERMANENT-PRESS SYSTEM

[75] Inventors: Bernard F. North, Rock Hill; George H. Lourigan, Chester, both of S.C.

[73] Assignee: Sun Chemical Corporation, New York, N.Y.

[22] Filed: Mar. 26, 1976

[21] Appl. No.: 670,705

Related U.S. Application Data

[63] Continuation-in-part of Ser. No. 565,071, April 9, 1975, Pat. No. 3,954,405.

[52] U.S. Cl. ..... 8/185; 8/186

[51] Int. Cl.[2] ..... D06M 13/34; D06M 13/36

[58] Field of Search ..... 8/185, 186

[56] References Cited

UNITED STATES PATENTS

| | | | |
|---|---|---|---|
| 3,165,374 | 1/1965 | Hushebeck | 8/185 |
| 3,526,474 | 9/1970 | Reeves et al. | 8/185 |
| 3,576,591 | 4/1971 | Cusano et al. | 8/185 |
| 3,811,210 | 5/1974 | Cashen et al. | 8/186 |

*Primary Examiner*—John Kight, III

*Attorney, Agent, or Firm*—Cynthia Berlow

[57] ABSTRACT

A fast, low-temperature curing composition for imparting permanent press properties to a cellulosic textile comprises an aqueous or aliphatic alcohol solution of dimethylol dihydroxyethylene urea or a partially or wholly methylated derivative thereof, aluminum sulfate, and sodium metaborate.

10 Claims, No Drawings

PERMANENT-PRESS SYSTEM

This application is a continuation-in-part of copending application Ser. No. 565,071 (filed Apr. 9, 1975), now U.S. Pat. No. 3,954,405.

This invention relates to the treatment of textile fabrics. More particularly it relates to a fast, low-temperature, low-energy system for imparting permanent press properties to such fabrics.

The use of durable press resins, for example dimethylol dihydroxyethylene urea (DMDHEU) and its derivatives, in treating textile fabrics to impart thereto wash-and-wear effects is well-known in the art. Treatment of fabrics with such reactants requires in general three operations which utilize significant amounts of energy, namely, drying, curing, and after-washing. For many years the textile industry has ignored the energy aspects of the finishing systems and has made decisions based on performance characteristics, production loads, economics, and so forth. The current energy crisis, brought on by fuel shortages and reflected in dramatic increases in fuel costs, requires textile finishers to study the energy requirements of treating fabrics with durable press resins; energy requirements have recently become a prime criterion in deciding which treating system should be used.

The amount of heat required to evaporate the water from a fabric is a relatively fixed value for a given system employing the lowest possible wet pick-up and a specific arrangement of cans, predriers, and ovens. Textile finishers can increase the pressures and reduce the wet pick-up to the lowest practical level.

The energy requirements for curing are directly affected by the selected resin/catalyst system. Also the need for an after-wash, a function of the resin/catalyst system, increases the energy demand.

With regard to the energy requirements, each increase in temperature of 25° F. can reduce the cure time by one-third up to more than one-half; for example, at 375° F. it takes 60 seconds to cure a conventional buffered DMDHEU/magnesium chloride system on a polyester/cotton fabric to the same degree as 25 seconds at 400° F.

The ideal treating system is one that cures very rapidly at low temperatures; however, for practical purposes an acceptable alternate is one that cures very rapidly at slightly higher temperatures.

Known low-temperature systems, originally developed for all-cotton fabrics to give a minimum of strength loss, do not give the high performance level demanded by the current market.

Known fast-curing systems usually require strong catalysts that are difficult to control under practical mill conditions or strong volatile acids that have a deleterious effect on the atmosphere.

In selecting a resin/catalyst system, a second factor must also be taken into consideration. Conventional treatments with DMDHEU often result in a rapid cure, but produce severe color changes on certain dyed fabrics and cause yellowing and severe scorching on white fabrics when the cured fabric is subjected to pressing during garment-manufacturing operations. These shade changes on dyed fabrics and the yellowing of white fabrics which occur when fabrics treated with conventional DMDHEU are cured are particularly pronounced when certain catalysts, such as zinc nitrate, are used.

To overcome these disadvantages, DMDHEU finishes can be buffered, that is, used with compounds that improve the whiteness and the shade-change properties. The addition of buffers, however, generally slows down the rate of cure.

A good rapid-cure system thus would be the one that has the curing rate of unbuffered DMDHEU resin and the performance characteristics of buffered DMDHEU resin. The system of this invention incorporates both of these advantages. According to this invention, a system that is a combination of a glyoxal resin (DMDHEU), sodium metaborate as the buffering agent, and aluminum sulfate as the catalyst provides a textile treatment which cures significantly faster than conventional treating systems with no deleterious side effects, such as shade change or undesired yellowing. The system effects great energy savings, giving comparable performance at a lower curing temperature or at a shorter curing time.

The glyoxal resin can be prepared in any known and convenient manner from glyoxal, urea, and formaldehyde, and the systems of this invention are applicable to dimethylol dihydrcxyethylene urea (DMDHEU), its partially and completely methylated derivatives, and other derivatives.

The buffering agent is sodium metaborate. It can be added per se to the resin or the resin bath; it can also be formed in situ by adding sodium hydroxide to sodium tetraborate (borax) until the ratio of Na:B is 1:1.

The catalyst, aluminum sulfate, may be added to the resin/sodium metaborate system or to the treating bath; the aluminum sulfate and the sodium metaborate may be premixed and then combined with the resin; or the resin and the aluminum sulfate may be premixed and then combined with the sodium metaborate. It may be aluminum sulfate per se or a hydrate thereof.

In general the ratio of the amount of sodium metaborate:DMDHEU is within the range of about 1:7–100; the preferred ratio is about 1:22.5. The ratio of aluminum sulfate:DMDHEU is generally 1:2-20 and preferably is about 1:5.

A composition containing all of the ingredients required when the product of this invention is applied to a fabric, i.e., the padding bath, will generally comprise about 1 to 30 parts by weight of DMDHEU or a derivative thereof; about 0.02 to 4.0 parts by weight of sodium metaborate; about 0.2 to 4.0 parts by weight of aluminum sulfate; and the remainder (to a total of 100 parts) of a solvent or a solvent mixture such as water or an aliphatic alcohol, e.g., methanol, ethanol, or isopropanol, or a mixture of water and aliphatic alcohol.

The treating agent of this invention is suitable for use with cellulosic textile fabrics, woven or non-woven, including 100% cellulosic fabrics, e.g., cotton, rayon, and linen, as well as blends, e.g., polyester/cotton or polyester/rayon. Such blends preferably but not necessarily contain at least 20% of cellulose. Both white and colored (printed, dyed, yarn-dyed, cross-dyed, etc.) fabrics can be effectively treated with the system of this invention.

The finishing agents may be applied to the textile fabric in any known and convenient manner, e.g., by dipping or padding, and will generally be applied from aqueous solution. Other conventional additives such as lubricants, softeners, bodying agents, water repellents, flame retardants, soil shedding agents, mildew inhibitors, anti-wet soiling agents, fluorescent brighteners, and the like may be used in the treating bath in conventional amounts. Such auxiliaries must not, however, interfere with the proper functioning of the buffer and the catalyst and must not themselves have a scorching tendency.

The amount of treating agent which is applied to the fabric will depend upon the type of fabric and its intended application; in general it is about 1 to 30 percent by weight and preferably is at least 4 percent by weight.

In the process of treating cellulosic textiles with the compositions of this invention, the textile is impregnated with the aqueous or alcoholic solution described above, and the impregnated textile is then dried and cured; the drying and curing steps may be consecutive or simultaneous. By using the specific treating system of this invention, curing is effected in about 10 seconds to fifteen minutes at a temperature within the range of about 450° F. to 250° F.

The treating system of this invention results in a fast cure rate with low energy requirements and with no shade change or yellowing problems.

In order that the present invention may be more fully understood, the following examples are given by way of illustration. No specific details contained therein should be construed as limitations on the present invention except insofar as they appear in the appended claims. Unless otherwise specified, all parts and percentages are by weight.

The rate of cure is shown by fabric smoothness as described in AATCC Test Method 124-1973 "Appearance of Durable Press Fabrics after Repeated Home Launderings". The ratings are from 1 to 5 with 1 being the poorest and 5 being the best.

Whiteness is determined by the method described in AATCC Test Method 110-1972 "Reflectance, Blue, and Whiteness of Bleached Fabric". The higher the number, the whiter the fabric.

The scorching due to retained chlorine was determined by following the procedure described in AATCC Test Method 92-1974 "Chlorine Retained, Tensile Low: Single Sample Method" and visually rating the extent of scorching.

EXAMPLE 1

A. A padding bath containing 10 parts of dimethylol dihydroxyethylene urea (DMDHEU), 0.4 part of sodium metaborate, 1.0 part of phosphoric acid, and 88.6 parts of distilled water was prepared.

B. Samples of both white and dyed fabrics containing 50% polyester and 50% cotton were impregnated with (1) the solution of part (A) above, (2) unbuffered DMDHEU/zinc nitrate, and (3) DMDHEU/zinc nitrate buffered with a hydroxypolycarboxylic acid partial salt. In each case the fabric was dried for 3 min. at 225° F. and cured 15 seconds at temperatures ranging from 350° F. to 425° F., and the smoothness was determined at 25° intervals. The results are tabulated below:

TABLE I

| ° F. | Fabric Smoothness | | |
|---|---|---|---|
| | (1) | (2) | (3) |
| 350 | 3.2 | 3.0 | 2.3 |
| 375 | 3.4 | 3.3 | 2.4 |
| 400 | 3.5 | 3.3 | 3.1 |
| 425 | 3.4 | 3.4 | 3.3 |

The system 1 appeared to be fully cured in 15 seconds at 375° F.; the unbuffered system 2 cured at about 400° F.; and the conventional buffered system 3 was not fully cured at 425° F.

C. The procedure of part (B) was repeated except that the impregnated fabrics were cured for 30 seconds at 450° F., and the whiteness of each sample was determined. The results are tabulated below:

TABLE II

| Whiteness | | |
|---|---|---|
| (1) | (2) | (3) |
| 102.5 | 26.5 | 105.8 |

The whiteness properties for buffered systems 1 and 3 are similar, and both are considerably better than the whiteness of unbuffered system 2.

D. The dyed fabrics treated with the buffered solutions of 1 and 3 showed no color change after curing, whereas the fabric treated with unbuffered system 2 showed severe color change after curing.

EXAMPLE II

The procedure of Example I was repeated except that 0.35 part of sodium tetraborate and 0.13 part of sodium hydroxide, giving a Na:B ratio of 1:1, were used instead of 0.4 part of sodium metaborate, and the fabric was a 65/35 instead of a 50/50 polyester/cotton blend. The results are tabulated below:

TABLE III

| ° F. | Fabric Smoothness | |
|---|---|---|
| | (1)* | (3)* |
| 350 | 3.2 | 2.3 |
| 375 | 3.4 | 2.4 |
| 400 | 3.5 | 3.1 |
| 425 | 3.4 | 3.3 |

*(1) DMDHEU/phosphoric acid/sodium metaborate
*(3) DMDHEU/zinc nitrate/hydroxypolycarboxylic acid partial salt The system 1 was fully cured in 15 seconds at 375° F., whereas system 3 was not fully cured at 425° F.

EXAMPLE III

The procedure of Example II was repeated except that the cure time was 60 seconds instead of 15 seconds. The results are tabulated below:

TABLE IV

| ° F. | Fabric Smoothness | |
|---|---|---|
| | (1)* | (3)* |
| 300 | 2.8 | 2.7 |
| 310 | 3.1 | 2.8 |
| 320 | 3.3 | 3.0 |
| 330 | 3.5 | 3.0 |
| 340 | 3.6 | 3.1 |
| 350 | 3.5 | 3.2 |
| 360 | 3.6 | 3.4 |

*DMDHEU/phosphoric acid/sodium metaborate
*DMDHEU/zinc nitrate/hydroxypolycarboxylic acid partial salt The system 1 was fully cured at about 340° F., whereas the conventional buffered system 3 was not fully cured after 60 seconds at 360° F. In both cases the treated fabrics retained their whiteness and the dyed fabrics retained their original shades at all curing temperatures.

EXAMPLE IV

Using the procedure of Example II, the effect of curing conditions on the smoothness of fabrics treated with the compositions of Example I(A) was determined over a wide range of temperatures (280° F. – 425° F.) and times (10 seconds-three minutes). The results are tabulated below:

TABLE V

| Curing Conditions | | Fabric Smoothness |
|---|---|---|
| Temperature | Time | |
| 280° F. | 1.0 minute | 3.4 |
| | 2.0 minutes | 3.4 |
| | 3.0 minutes | 3.5 |
| 300° F. | 1.0 minute | 3.4 |
| | 1.5 minutes | 3.5 |
| | 2.0 minutes | 3.5 |
| 325° F. | 0.5 minute | 3.5 |
| | 1.0 minute | 3.5 |
| | 1.5 minutes | 3.4 |
| | 2.0 minutes | 3.5 |
| 425° F. | 10 seconds | 3.5 |
| | 20 seconds | 3.6 |
| | 30 seconds | 3.6 |

As can be seen from these data, under a wide combination of curing conditions the smoothness ratings are high and about the same for each set of temperature/-time conditions.

The shade change and whiteness of all of the treated fabrics were satisfactory.

EXAMPLE V

To determine the advantages of the permanent press system of Example I(A) in actual mill operation, 2.00 yard/pound cotton twill was treated with (a) a conventional buffered DMDHEU/zinc nitrate system and (b) the DMDHEU/phosphoric acid/sodium metaborate system.

System (a) was dried at 35 yards per minute on a 90-foot tenter frame with temperatures set at 300° F., 300° F., and 350° F., the first two sections being steam-heated and the last section gas-fired. The dried fabric went from the frame to a curing oven set at 340° F. for 1.5 minutes.

System (b) was dried at 35 yards per minute on a 90-foot tenter frame with temperatures set at 300° F., 300° F., and 375° F. Under these conditions it was fully cured and did not go to a curing oven. The fabric exhibited shrinkage and wrinkle-recovery properties similar to those of part (a) and its breaking strength was slightly higher.

EXAMPLE VI

A 50/50 polyester/cotton brushed napped twill treated with DMDHEU/phosphoric acid/sodium metaborate was dried at 35 yards per minute on a 90-foot tenter frame with temperatures set at 300° F., 300° F., and 400° F., without a curing oven. The treated fabric had better shrinkage control and crease angles properties than conventionally treated goods which had to be cured additionally in an oven.

EXAMPLE VII (A) A padding bath containing 10 parts of DMDHEU; 0.35 part of sodium tetraborate and 0.13 part of sodium hydroxide, giving a Na:B ratio of 1:1; 0.95 part of aluminum sulfate; 0.12 part of an eleven mole ethylene oxide adduct of nonylphenol; and 88.45 parts of water was prepared.

B. Samples of both white and dyed fabrics containing 50 percent of polyester and 50 percent of cotton were impregnated with (1) the solution of part (A) above, (2) DMDHEU and aluminum sulfate in the ratio of 10:0.95 (3) unbuffered DMDHEU/zinc nitrate buffered with hydroxypolycarboxylic acid partial salt. In each case the fabric was dried for 3 min. at 225° F. and cured 10 seconds at temperatures ranging from 360° F. to 420° F., and the smoothness and chlorine scorch were determined at 20° intervals. The results are tabulated below:

TABLE VI

| | Fabric Smoothness | | | |
|---|---|---|---|---|
| ° F. | (1) | (2) | (3) | (4) |
| 360 | 3.3 | 3.4 | 3.4 | 3.0 |
| 380 | 3.3 | 3.5 | 3.6 | 3.0 |
| 400 | 3.5 | 3.7 | 3.8 | 3.4 |
| 420 | 3.6 | 3.7 | 3.9 | 3.5 |

TABLE VII

| | Chlorine scorch | | | |
|---|---|---|---|---|
| ° F. | (1) | (2) | (3) | (4) |
| 360 | None | None | None | None |
| 380 | None | None | None | Moderate |
| 400 | None | None | None | Moderate |
| 420 | None | None | None | Moderate |

C. The procedure of part (B) was repeated except that the impregnated fabrics were cured for 45 seconds at 450° F., and the whiteness of each sample was determined. The results are tabulated below:

TABLE VIII

| | | Whiteness | |
|---|---|---|---|
| (1) | (2) | (3) | (4) |
| 90.4 | 64.5 | 17.7 | 68.6 |

The whiteness value for the system of this invention 1 is better than that for the DMDHEU/aluminum sulfate system 2 and the buffered DMDHEU/zinc nitrate system 4 and considerably better than the unbuffered DMDHEU/zinc nitrate system 3.

In addition, the system of this invention 1 cures faster than the buffered DMDHEU/zinc nitrate system 4 and exhibits better chlorine resistance than system 4. Also, the system of this invention 1 shows better resistance to chlorine scorch than the buffered DMDHEU/zinc nitrate system 4. The cure rate of the system of this invention 1 is not so fast as the DMDHEU/aluminum sulfate system 2 or the unbuffered DMDHEU/zinc nitrate system 3; however, both systems 2 and 3 are not practical because of the fabric discoloration shown by the low whiteness values.

D. The dyed fabrics treated with solutions 1, 2, and 4 showed no color change after curing, whereas the fabric treated with the unbuffered resin system 3 showed severe color change after curing.

EXAMPLE VIII

A. A padding bath containing 8 parts of DMDHEU; 0.28 part of sodium tetraborate and 0.10 part of sodium hydroxide, giving a Na:B ratio of 1:1; 0.76 part of aluminum sulfate; 0.12 part of an eleven mole ethylene oxide adduct of nonylphenol; and 90.74 parts of water was prepared.

B. Samples of white fabric containing 50 percent of polyester and 50 per cent of cotton were impregnated with (1) the solution of part (A) above and (2) a solution containing 8 parts of DMDHEU; 0.28 part of sodium tetraborate and 0.10 part of sodium hydroxide, giving a Na:B ratio of 1:1; 0.80 part of phosphoric acid;

0.12 part of an eleven mole ethylene oxide adduct of nonylphenol; and 90.78 parts of water. In each case the fabric was dried for 3 minutes at 225° F. and cured for 10 seconds at either 380° F. or 420° F. The chlorine scorch is shown below:

| ° F. | (1) | (2) |
|---|---|---|
| 380° F. | None | Moderate |
| 420° F. | None | Very Slight |

The resistance to scorching after chlorination of the system of this invention 1 is superior to that of the DMDHEU/metaborate/phosphoric acid system 2.

EXAMPLE IX

The procedure of Example VII was repeated with each of the following instead of DMDHEU: partially methylated DMDHEU and methylated DMDHEU. The results were comparable.

EXAMPLE X

The procedure of Example VII was repeated using each of the following solvents instead of water: methanol, ethanol, and isopropanol. The results were comparable.

EXAMPLE XI

The procedure of Example VII was repeated except that the DMDHEU and the sodium metaborate were premixed and then combined with the aluminum sulfate. The results were comparable.

EXAMPLE XII

The procedure of Example VII was repeated except that the DMDHEU and the aluminum sulfate were premixed and then combined with the sodium metaborate. The results were comparable.

EXAMPLE XIII

The procedure of Example VII was repeated except that the aluminum sulfate and the sodium metaborate were premixed and then combined with the DMDHEU. The results were comparable.

EXAMPLE XIV

The procedure of Example VII was repeated except that the fabric was each of the following instead of 50/50 polyester/cotton: 65/35 polyester/cotton, 50/50 polyester/rayon, 65/35 poyester/rayon, woven 100% cotton, and knit 100% cotton. The results were comparable.

As evidenced by these data, the DMDHEU/aluminum sulfate/sodium metaborate system of the present invention is superior to conventional unbuffered and buffered DMDHEU/catalyst systems both in the saving of energy and in the preserving of fabric properties. The curing is fast and can be accomplished at lower temperatures. The durable press properties are improved. There is no undesirable yellowing of white fabrics or change in shade of dyed fabrics. The system contains no chlorides and the formaldehyde levels are low. In addition, the DMDHEU/aluminum sulfate/sodium metaborate system shows improved resistance to chlorine scorch.

What is claimed is:

1. A fast, low-temperature curing composition for imparting permanent press properties to a cellulosic textile which consists essentially of an aqueous or aliphatic aliphatic alcohol solution of dimethylol dihydroxyethylene urea or a partially or wholly methylated derivative thereof, aluminum sulfate, and sodium metaborate.

2. The composition of claim of 1 wherein the dimethylol dihydroxyethylene urea or derivative thereof is premixed with the aluminum sulfate.

3. The composition of claim 1 wherein the dimethylol dihydroxyethylene urea or derivative thereof is premixed with the sodium metaborate.

4. The composition of claim 1 wherein the aluminum sulfate is premixed with the sodium metaborate.

5. In a process for producing crease-resistant textiles comprising impregnating a textile with a solution of dimethylol dihydroxyethylene urea or a partially or wholly methylated derivative thereof, a catalyst, and a buffering agent and heating the impregnated textile to cure the resulting impregnated textile and impart crease-resistance thereto, the improvement wherein the catalyst is aluminum sulfate and the buffering agent is sodium metaborate.

6. The improvement of claim 5 wherein the sodium metaborate is formed in situ by the reation of sodium tetraborate and sodium hydroxide.

7. The process of claim 5 wherein the dimethylol dihydroxyethylene urea or derivative thereof is premixed with the aluminum sulfate.

8. The process of claim 5 wherein the dimethylol dihydroxyethylene urea or derivative thereof is premixed with the sodium metaborate.

9. The process of claim 5 wherein the aluminum sulfate is premixed with the sodium metaborate.

10. A crease-resistant textile produced by the process of claim 5.

* * * * *